United States Patent [19]
Hatcher et al.
[11] 4,408,376
[45] Oct. 11, 1983

[54] APPARATUS FOR DRAWING YARN

[75] Inventors: Charles S. Hatcher, Greenville, S.C.; Kenneth E. Smith, Bartlesville, Okla.

[73] Assignee: Phillips Petroleum Company, Bartlesville, Okla.

[21] Appl. No.: 900,941

[22] Filed: Apr. 28, 1978

Related U.S. Application Data

[62] Division of Ser. No. 412,656, Nov. 5, 1973, abandoned.

[51] Int. Cl.[3] ..... D02J 1/22; B29C 17/02
[52] U.S. Cl. ..... 28/245; 57/310
[58] Field of Search ..... 28/245, 246; 57/55.5, 57/157 S, 310

[56] References Cited

U.S. PATENT DOCUMENTS

| | | | |
|---|---|---|---|
| 3,380,131 | 4/1968 | Gray | 28/246 X |
| 3,444,683 | 5/1969 | Hessenbruch | 57/157 S UX |
| 3,711,898 | 1/1973 | Debbas | 264/210 F UX |
| 3,780,516 | 12/1973 | Kimbrell | 28/246 X |
| 3,781,953 | 1/1974 | Stegelman | 264/290 R X |
| 3,930,292 | 1/1976 | Schippers et al. | 28/246 X |

FOREIGN PATENT DOCUMENTS

| | | | |
|---|---|---|---|
| 4723965 | 7/1972 | Japan | 28/245 |

*Primary Examiner*—Robert Mackey

[57] ABSTRACT

A plurality of yarns are drawn from supply sources onto feed rolls and over a set of draw rolls in adjacent relationship. The yarns are urged into a desired contiguous relationship on the draw rolls by a concave guide surface in the course of passing from the yarn feed rolls to the draw rolls.

7 Claims, 5 Drawing Figures

APPARATUS FOR DRAWING YARN

This is a division of copending application Ser. No. 412,656, filed Nov. 5, 1973, now abandoned.

BACKGROUND OF THE INVENTION

This invention relates to the processing of yarns, and more particularly pertains to the drawing of a plurality of yarns about draw rolls in adjacent, untwisted relation. The provided process has particular application to the processing of yarn ends, each of which has a different color, which ends are to be subsequently twisted into a single yarn having uniform color properties throughout its length.

In the processing of yarns, the prior art has employed various expedients for purposes of facilitating the drawing of yarn from feed rolls. Thus, in Aelion et al. U.S. Pat. No. 3,337,930 the use of a straight pin between series of draw rolls to prevent slippage and assist in the drawing of the yarns from a supply source is shown. Although helpful in positioning the yarns on the draw rolls, such pins do not control the yarn relative dispositions on the draw rolls so as to prevent cabling thereof.

Also, combing or use of pins has been employed for controlling the order of yarn ends in the draw zone. However, combing or the use of a series of yarn-spacing pins has in the past caused "lace-up" and other operating problems. In addition, the separation of the yarn ends by spacer pins allows heat loss to more readily occur in the interval between the draw rolls and yarn sources, thereby rendering the yarn drawing operation less efficient.

In accordance with one embodiment of the invention, a plurality of yarns of different colors, which are to be combined subsequently into a single yarn, are drawn over a set of draw rolls and maintained in an adjacent contiguous relationship while running on the rolls. A means for effecting the desired yarn relationship comprises a roller having an annularly relieved concave outer periphery. The guide is placed at an angle of approximately 45° relative to the plane of the yarns in the draw zone defined by the yarns between the feed rolls and draw rolls. The concave guide surface of the roller displaces the yarns a small interval of less than one inch from their original plane and urges them into contiguous relationship.

Accordingly, it is an object of this invention to provide a method of simultaneously drawing a plurality of yarns over a set of draw rolls and maintaining the yarns in the same relative position by having the yarns engage a concave guide surface set at an angle to the plane of the yarns moving onto the draw rolls.

It is another object of the invention to provide a novel guide having a concave surface adapted to engage a plurality of yarns in the course of moving from feed rolls onto draw rolls whereby the relative order of the yarns is maintained and cabling of the yarns is avoided.

The above and other objects of this invention will become apparent from the following description when read in the light of the accompanying drawing in which.

DESCRIPTION OF THE INVENTION

Figure 1:
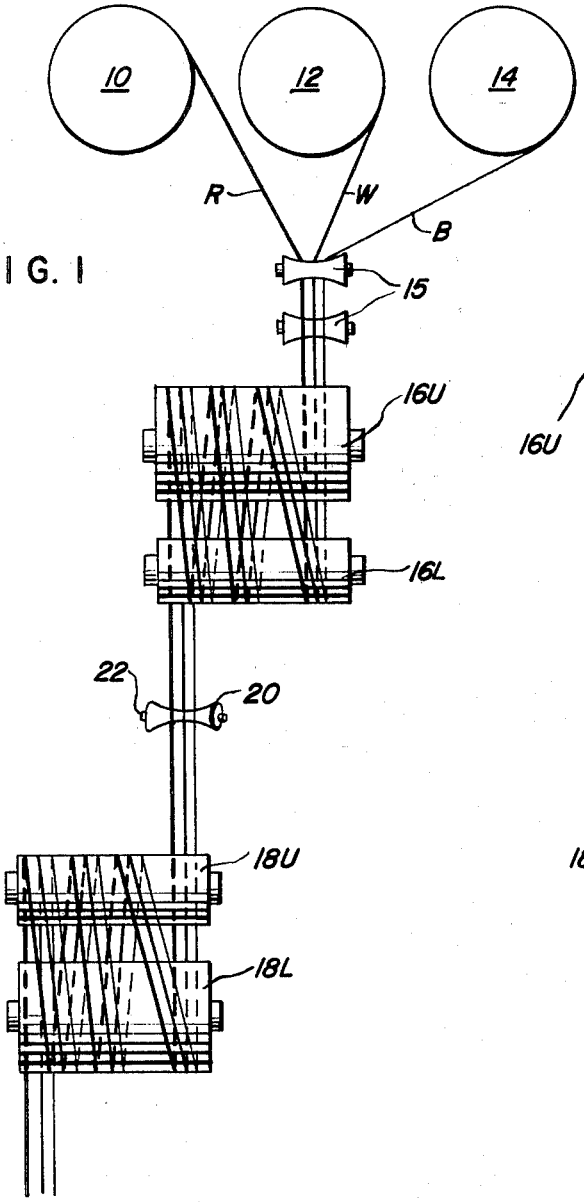
FIG. 1 is a side view illustrating in a somewhat schematic manner apparatus whereby a plurality of yarns are engaged by a concave guide surface in the course of passing from feed rolls to draw rolls in accordance with the provided invention.

Referring now to FIG. 1 of the drawing, three yarn source rolls 10, 12 and 14 which may have wound thereon yarns R, W and B of three different colors are disposed above feed rolls 16U and 16L. After engaging guides 15, the yarns are wound about the feed rolls prior to passing to the draw rolls 18U and 18L. The latter rolls are driven at a desired increased rate of speed relative to the speed of the feed rolls so as to effect the desired stretching of the yarns R, W and B wound thereabout.

Figure 5:
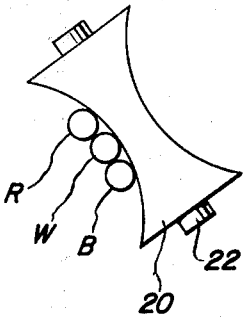
FIG. 5 is a view similar to FIG. 4 illustrating the roller-yarn relationship at the points of roller-yarn contact.
Figure 4:
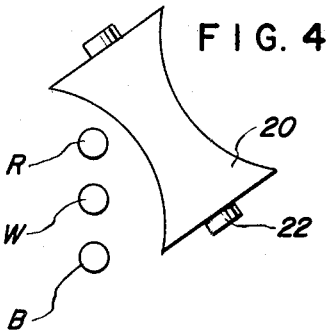
FIG. 4 is a sectional view illustrating a guide roller of this invention in elevation and depicting the relative disposition of the yarns relative to the roller as viewed along the normal yarn paths leading from the feed rolls.

In accordance with this invention, the yarns R, W and B are maintained in desired untwisted, side-by-side relationship on the draw rolls by engaging a concave guide surface such as roller 20 having an annularly relieved concave outer periphery as is most clearly seen from FIGS. 4 and 5. The roller 20 may be rotatably mounted on pin 22.

Figure 2:
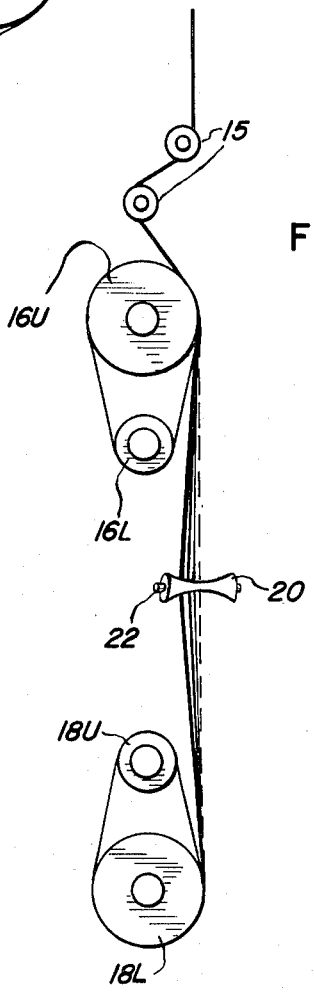
FIG. 2 is an end view of the apparatus illustrated in FIG. 1.

Roller 20 is preferably formed of ceramic or other wear-resistant material or composition. The roller 20, upon engaging the yarns R, W and B slightly displaces the same from the vertical plane defined by the normal straight-line yarn passage from the feed rolls to the draw rolls toward the axes of said rolls as is clearly seen from FIG. 2. The linear displacement of the engaged yarn, between the normal plane illustrated in dotted lines in FIG. 2 and the true yarn location illustrated in full lines is preferably less than one inch in the vicinity of roller engagement.

Figure 3:
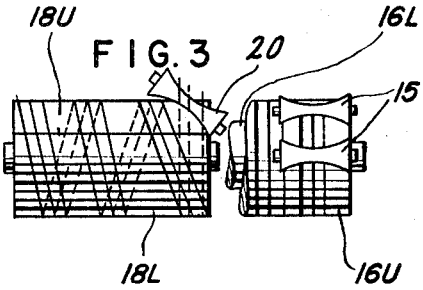
FIG. 3 is a fragmentary top plan view of the apparatus of FIGS. 1 and 2, partly broken away, illustrating the angular disposition of the concave roller of this invention to the plane of the yarns passing between the feed and draw rolls.

The yarns upon engaging the periphery of roller 20, are gathered into an adjacent relationship illustrated in FIG. 5 from the spaced relationship illustrated in FIG. 4. It will be noted from FIG. 5 that the curvature of the guide surface is such that the yarns are in substantially horizontal alignment thereon at the points of contact, in which alignment they proceed to the underlying draw rolls. As a result of contacting roller 20, the yarns R, W and B are guided about the peripheries of draw rolls 18U and 18L without twisting or cabling. The relative yarn dispositions illustrated in FIGS. 1 and 3 are schematic with the actual yarn relationships being more clearly shown in FIGS. 4 and 5.

It is seen from the figures of the drawing that roller 20 comprises a cylinder which has been annularly relieved about its periphery. Thus, a section taken through the longitudinal axis thereof defines a planar figure having opposed curved edges coincident with the roller outer periphery. Such curves comprising the concavity of the roller define a surface whereby yarns engaging the same are urged toward the longitudinal midpoint of the roller comprising the deepest point of the curve. (See FIG. 5)

The maintaining of the same relative dispositions between yarns R, W and B is of particular importance where such yarns are of different colors and are to be subsequently employed in the formation of a heather product as by entangling such yarns into a single yarn having complete color uniformity. Also, the yarns, by being maintained in the same adjacent relationship across the draw rolls, are, of course, easier to string up.

The guide roller 20, by way of example, may have the concavity of its outer periphery disposed in a plane traversing the roller longitudinal axis formed along a one and one-half inch radius. The guide roller 20 controls the relative order of the yarns, controls placement of such yarns on the draw roll and maintains the yarns in a relatively tight yarn bundle (see FIG. 5) so as to minimize heat loss which is undesired in the course of passing the yarns from the yarn sources to the draw rolls. Accordingly, the steps above described are beneficial even when processing yarns of the same color since a more efficient operation is assured.

The foregoing process steps may be employed, for example, as preliminary steps in the formation of a heather product made from yarns of a thermoplastic material such as polypropylene. The assurance of uniform color in the yarns employed in such product, in turn, assures the absence of color streaks.

We claim:

1. Apparatus for cold drawing a plurality of yarns comprising:

(a) a plurality of spaced supply means adapted to supply an equal number of individual yarns;

(b) driven feed roll means adapted to draw said yarns from said supply means in a single, first plane with said yarns arranged in spaced parallel relationship to one another and in a predetermined order relative to one another in said first plane;

(c) heated, driven draw roll means spaced from said feed roll means in the direction of travel of said yarns and adapted to draw said yarns from said feed roll means at a speed greater than the speed of said feed roll means and in a normal, second plane parallel to said first plane with said yarns in said predetermined order relative to one another in said second plane; and (d) elongated guide means having a concave surface positioned between said feed roll means and said draw roll means with the concavity thereof toward said yarns and the tangent at the midpoint of said concave surface at an angle approximately 45° relative to said second plane and adapted to urge said yarns into contiguous side-by-side relation and in said predetermined order along said concave surface and on said draw roll means.

2. Apparatus in accordance with claim 1 wherein the first and second planes are coincident.

3. Apparatus in accordance with claim 1 wherein the guide means is also positioned to displace the yarns from the normal second plane toward the axes of the feed roll means and the draw roll means.

4. Apparatus in accordance with claim 3 wherein the guide means is positioned to displace the yarns toward the axes of a feed roll means and the draw roll means a distance of less than about one inch.

5. Apparatus in accordance with claim 1 wherein the concave surface of the guide means comprises the outer periphery of a roller concavely curved along its length.

6. Apparatus in accordance with claim 1 wherein the concavity of the guide means is formed along a radius of approximately one and one-half inches as measured in a plane containing the longitudinal axis of a roller.

7. Apparatus in accordance with claim 1 wherein a second guide means is positioned between the supply means and the feed roll means and is adapted to guide said yarns from said supply means to said feed roll means in the first plane with said yarns arranged in spaced parallel relationship to one another and in the predetermined order relative to one another in said first plane.

* * * * *